US008576023B1

(12) United States Patent
Buckley et al.

(10) Patent No.: US 8,576,023 B1
(45) Date of Patent: Nov. 5, 2013

(54) STRIPLINE-TO-WAVEGUIDE TRANSITION INCLUDING METAMATERIAL LAYERS AND AN APERTURE GROUND PLANE

(75) Inventors: Michael J. Buckley, Marion, IA (US); Wajih A. El Sallal, Cedar Rapids, IA (US); Brian J. Herting, Marion, IA (US); John C. Mather, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 291 days.

(21) Appl. No.: 12/763,683

(22) Filed: Apr. 20, 2010

(51) Int. Cl.
*H01P 5/107* (2006.01)

(52) U.S. Cl.
USPC ..... 333/26; 333/33

(58) Field of Classification Search
USPC ..... 333/26, 33
See application file for complete search history.

(56) References Cited

U.S. PATENT DOCUMENTS

| | | | | |
|---|---|---|---|---|
| 6,154,176 | A * | 11/2000 | Fathy et al. | 343/700 MS |
| 6,958,662 | B1 * | 10/2005 | Salmela et al. | 333/26 |
| 2007/0188258 | A1 * | 8/2007 | Ohno et al. | 333/26 |
| 2008/0030284 | A1 * | 2/2008 | Tanaka et al. | 333/33 |
| 2010/0033272 | A1 * | 2/2010 | O'Connell et al. | 333/21 R |

* cited by examiner

*Primary Examiner* — Benny Lee
(74) *Attorney, Agent, or Firm* — Donna P. Suchy; Daniel M. Barbieri

(57) ABSTRACT

The present invention is directed to an interface for connecting a waveguide manifold of a transition to a stripline manifold of the transition. The interface may include a plurality of metamaterial layers, each including a metamaterial(s). The interface may further include a ground plane layer which may be connected to both the plurality of metamaterial layers and to the stripline manifold. Further, the interface may include a plurality of ground vias which may form channels through each of the layers of the interface and through the stripline manifold for providing a ground structure for the interface. The interface is further configured for forming a resonant structure which provides a low-loss, broadband conversion between a stripline mode and a waveguide mode for electromagnetic energy traversing through the interface between the waveguide manifold and the stripline manifold.

7 Claims, 6 Drawing Sheets

STRIPLINE-TO-WAVEGUIDE TRANSITION INCLUDING METAMATERIAL LAYERS AND AN APERTURE GROUND PLANE

FIELD OF THE INVENTION

The present invention relates to the field of stripline-to-waveguide transitions and more particularly to a metamaterial-loaded stripline-to-waveguide transition.

BACKGROUND OF THE INVENTION

A number of currently available stripline-to-waveguide transitions may not provide a desired level of performance over a desired bandwidth range (e.g.—over a broad bandwidth). For example, currently available stripline-to-waveguide transitions may suffer a poor match in return loss over a given frequency band. Thus, currently available stripline-to-waveguide transitions may only provide a desirable level of performance over a narrow bandwidth.

Thus, it would be desirable to have a stripline-to-waveguide transition which addresses the problems associated with currently available solutions.

SUMMARY OF THE INVENTION

Accordingly an embodiment of the present invention is directed to an interface, including: a plurality of metamaterial layers, each of the plurality of metamaterial layers including a metamaterial; and a ground plane layer, the ground plane layer being connected to the plurality of metamaterial layers, the ground plane layer being configured with a plurality of ground plane slots, the ground plane layer configured for being connected to a first manifold of a transition, wherein the interface is configured with a plurality of ground vias, the plurality of ground vias being formed through the plurality of metamaterial layers and through the ground plane layer for providing a ground structure for the interface, the interface being further configured for connecting the first manifold of the transition to a second manifold of the transition.

A further embodiment of the present invention is directed to an interface, including: a plurality of metamaterial layers, each of the plurality of metamaterial layers including a metamaterial; and a ground plane layer, the ground plane layer being connected to the plurality of metamaterial layers, the ground plane layer being configured with a plurality of ground plane slots, the ground plane layer configured for being connected to a stripline manifold of a transition, wherein the interface is configured with a plurality of ground vias, the plurality of ground vias being formed through the plurality of metamaterial layers and through the ground plane layer for providing a ground structure for the interface, the interface being further configured for connecting the stripline manifold of the transition to a waveguide manifold of the transition.

A still further embodiment of the present invention is directed to a transition, including: an interface; a waveguide manifold, the waveguide manifold being connected to the interface, the waveguide manifold including an input portion configured for receiving an input, the waveguide manifold further including an output portion configured for providing an output, the output being based upon the received input; and a stripline manifold, the stripline manifold being connected to the interface, the stripline manifold being connected to the waveguide manifold via the interface, the interface including: a plurality of metamaterial layers, each of the plurality of metamaterial layers including a metamaterial; and a ground plane layer, the ground plane layer being connected to the plurality of metamaterial layers, the ground plane layer being configured with a plurality of ground plane slots, the ground plane layer configured for being connected to the stripline manifold of a transition, the interface being configured with a plurality of ground vias, the plurality of ground vias being formed through the plurality of metamaterial layers, through the ground plane layer, and through the stripline manifold, for providing a ground structure for the interface, wherein the output portion of the waveguide manifold is oriented against the interface.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
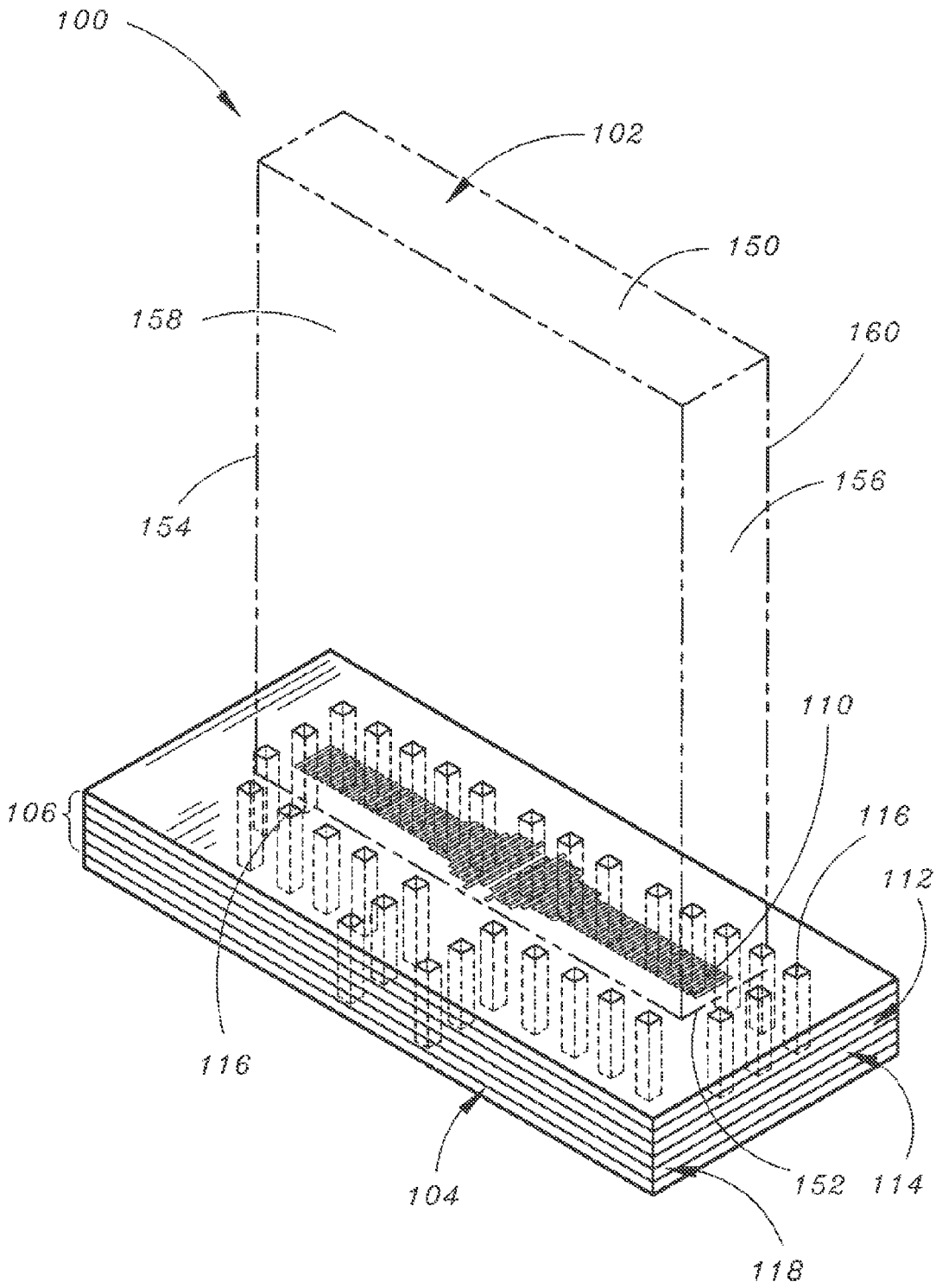
FIG. 1 is an isometric view of a transition in accordance with an exemplary embodiment of the present invention.

Referring now to FIG. 1, a transition in accordance with an exemplary embodiment of the present invention is shown. In an exemplary embodiment of the present invention, the transition 100 may be used in or implemented as part of a Rockwell Collins Satellite Communications System Military Satellite Flat Panel Satellite Communications antenna (RCSCS MilSat Flat Panel SatCom antenna). In alternative embodiments of the present invention, the transition 100 may be used in or implemented as part of one of the following: a GS RCSCS MilSat Flat Panel SatCom antenna; a DataPath MilSat antenna; and a DataPathGS RCSCS MilSat Flat Panel SatCom antenna.

Figure 2:
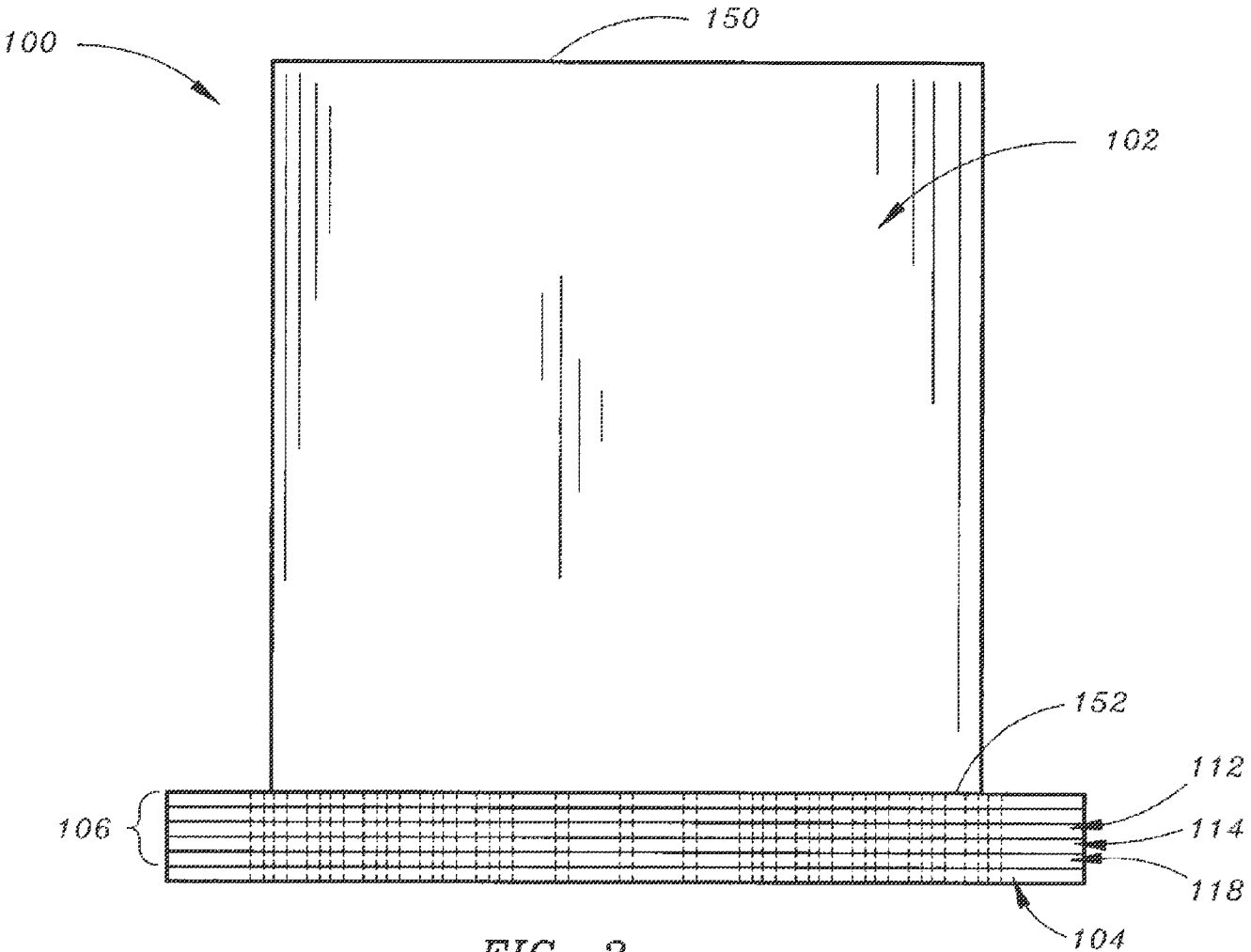
FIG. 2 is a cross-sectional view of the transition shown in FIG. 1, in accordance with an exemplary embodiment of the present invention.

In current embodiments of the present invention as depicted in FIGS. 1 and 2, the transition 100 may include a first manifold 102, such as a waveguide manifold (e.g.—a waveguide, the waveguide being any one of a number of various shapes, such as a rectangular-shaped waveguide, a circular-shaped waveguide, etc.) 102. For instance, the waveguide 102 may be configured for feeding a waveguide combiner (not shown).

In exemplary embodiments of the present invention, the transition 100 may further include a second manifold 104. For instance, the second manifold 104 may be a stripline manifold (e.g.—a stripline, a stripline feed manifold) 104 (shown in FIGS. 1, 2 and 6). In further exemplary embodiments of the present invention, the stripline manifold 104 may be at least partially formed of printed circuit board material for providing a reduced volume, low profile stripline manifold 104. In alternative embodiments of the present invention, the second manifold 104 may be a microstrip manifold or a suspended stripline manifold technology.

In further embodiments of the present invention, the transition 100 may further include an interface 106 (e.g.—a stripline-to-waveguide converter). The interface 106 may be configured for connecting the first manifold (e.g.—the waveguide) 102 to the second manifold (e.g.—the stripline manifold) 104 (as shown in FIG. 1 and FIG. 2). In exemplary embodiments of the present invention, the waveguide manifold 102 may include an input portion, the input portion configured for receiving an input. In further embodiments of the present invention, the waveguide manifold 102 may further include an output portion, the output portion configured for providing a waveguide output, the waveguide output being based upon the received input. For example, in embodiments in which the waveguide manifold 102 is configured as a rectangular-shaped waveguide (as shown in FIG. 1), the input portion (e.g.—an input end) may be (e.g.—formed by) a first end 150 of the waveguide 102, while the output portion (e.g.—an output end) may be (e.g.—formed by) a second end 152 of the waveguide, the second end 152 being disposed (e.g.—oriented) generally opposite the first end 150 as shown in FIG. 2. Further, in the embodiment of the waveguide manifold 102 shown in FIG. 1, the waveguide manifold 102 may include a first narrow wall 154 and a second narrow wall 156, the first narrow wall 154 being disposed (e.g.—oriented) generally opposite the second narrow wall 156. Still further, in the embodiment of the waveguide manifold 102 shown in FIG. 1, the waveguide manifold 102 may include a first broad wall 158 and a second broad wall 160, the first broad wall 158 being disposed (e.g.—oriented) generally opposite the second broad wall 160. In the illustrated embodiment of the present invention, the second end 152 of the waveguide 102 has a first surface area, the first broad wall 158 has a second surface area and the second broad wall 160 has a third surface area, with the first surface area being smaller than either the second surface area or the third surface area. In exemplary embodiments of the present invention, the second end 152 of the waveguide 102 may be oriented towards (e.g.—oriented against, disposed against, in direct physical contact with) the interface 106 and may be configured for connecting the waveguide 102 to the interface 106, and may be further configured for providing the waveguide output to the interface 106. Further, in the embodiment of the waveguide manifold 102 shown in FIG. 1 and FIG. 2, interface 106 may include a ground plane layer 118.

Figure 5:
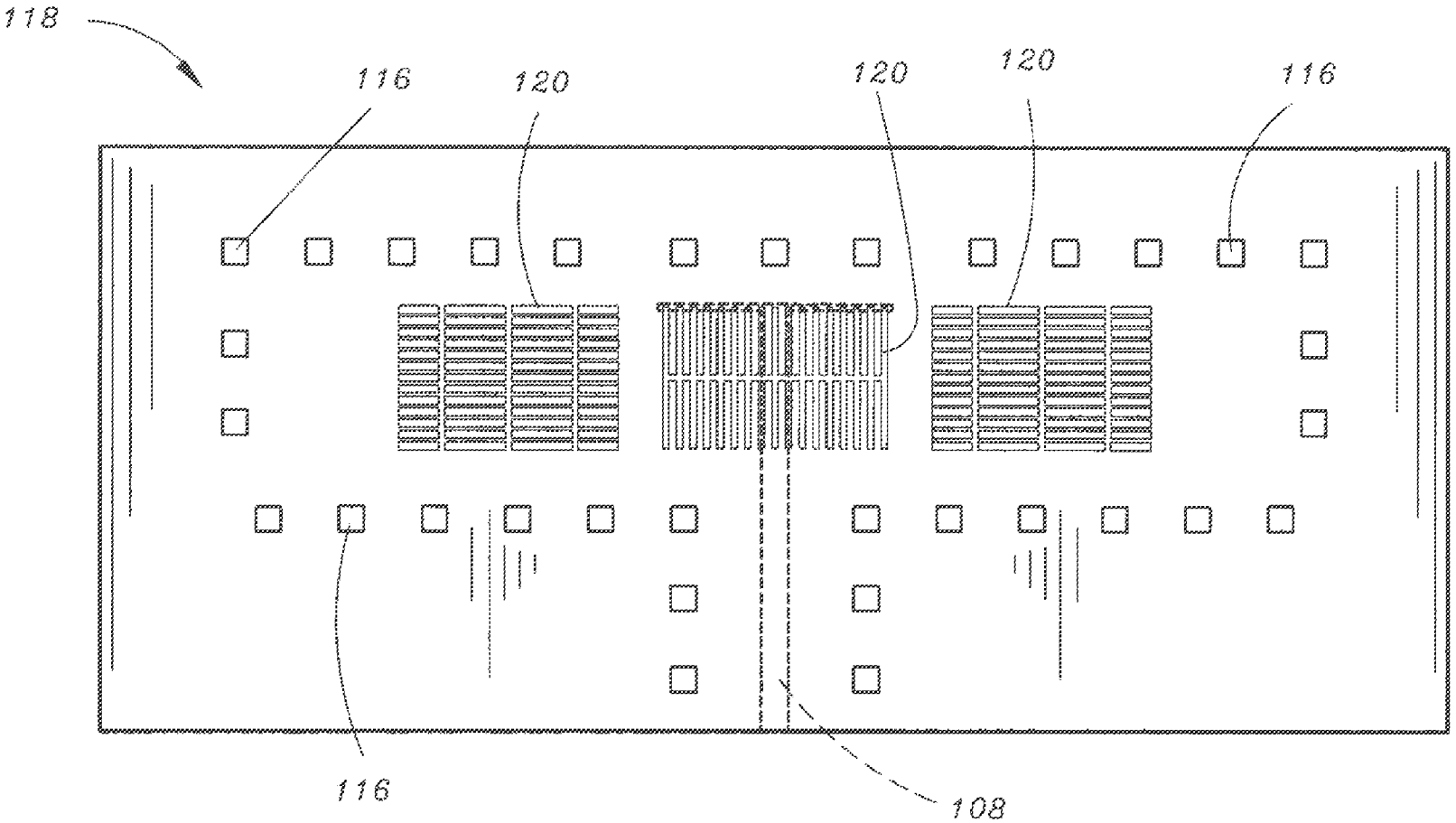
FIG. 5 is a top plan view of a ground plane layer of the interface of the transition shown in FIG. 1, in accordance with an exemplary embodiment of the present invention.
Figure 6:
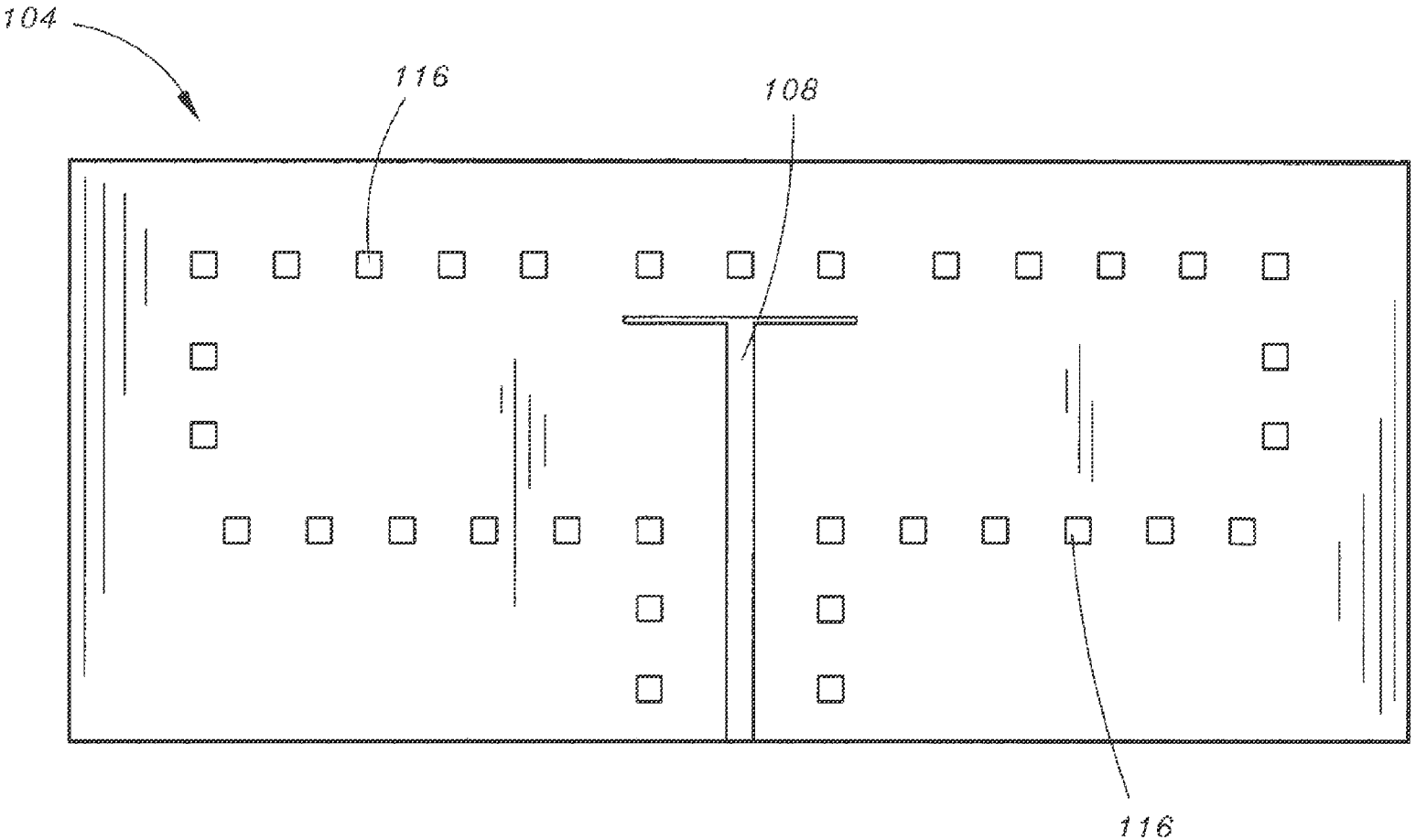
FIG. 6 is a top plan view of a stripline manifold of the transition shown in FIG. 1, in accordance with an exemplary embodiment of the present invention.

In current embodiments of the present invention, the stripline manifold 104 may be configured for being connected to a low profile aperture array (not shown) of the transition 100. In further embodiments of the present invention, the stripline manifold 104 may be configured for feeding the low profile aperture array of the transition 100. For example, the stripline manifold 104 may include a fifty ohm stripline feed 108 (as shown in FIG. 5 and FIG. 6) configured for feeding the low profile aperture array of the transition 100. In further embodiments, the stripline manifold 104 may provide a small footprint structure which does not require a matching circuit. Further, as mentioned above, because the waveguide manifold 102 may be connected to the stripline manifold 104 via the interface 106, and the stripline manifold 104 may be connected to the low profile aperture array of the transition 100, the waveguide manifold 102 may also be connected to the low profile aperture array of the transition or feed circuitry 100, such that the waveguide manifold 102 and the stripline manifold 104 may both be configured for feeding the low profile aperture array of the transition 100.

In exemplary embodiments of the present invention, the interface 106 may be configured for forming a resonant structure which provides a transition or conversion (e.g.—a stripline-to-waveguide transition, a stripline-to-waveguide conversion) between a first mode (e.g.—a stripline mode, Transverse Electromagnetic (TEM) stripline mode) and a second mode (e.g.—a waveguide mode, a fundamental mode of the waveguide (which may be TE10 for a rectangular-shaped waveguide and TE11 for a circular-shaped waveguide)) for electromagnetic energy traversing (e.g.—bidirectionally) through the interface 106 between the waveguide 102 and the stripline 104. In current embodiments of the present invention, the interface 106 may include a plurality of layers. In further embodiments of the present invention, the interface 106 (e.g.—the plurality of layers of the interface 106) may be formed of printed circuit board material for providing a reduced volume (e.g.—low profile) interface 106 and for promoting ease of construction of the interface 106. For instance, the interface 106 may be constructed (e.g.—manufactured) using printed circuit board manufacturing techniques which may promote reduced manufacturing costs for the interface 106. In alternative embodiments of the present invention, the interface 106 may be formed of liquid crystal polymer (LCP).

In further embodiments of the present invention, one or more of the plurality of layers of the interface 106 may include (e.g.—may contain; may be loaded with; may have embedded within them; may have configured on them) one or more metamaterials 110. For instance, in at least one embodiment of the present invention (as shown in FIG. 1), the interface 106 may include a first metamaterial layer (e.g.—an upper metamaterial layer) 112 (shown in FIG. 2 and FIG. 3) and a second metamaterial layer (e.g.—a lower metamaterial layer) 114 (shown in FIG. 2 and FIG. 4). The "upper" and "lower" designations set forth above in describing the metamaterial layers 112, 114 refers to relative proximity of the metamaterial layers to the waveguide manifold 102. For example, the upper metamaterial layer 112 may be located at a closer proximity to the waveguide 102 than the lower metamaterial layer 114.

Figure 3:
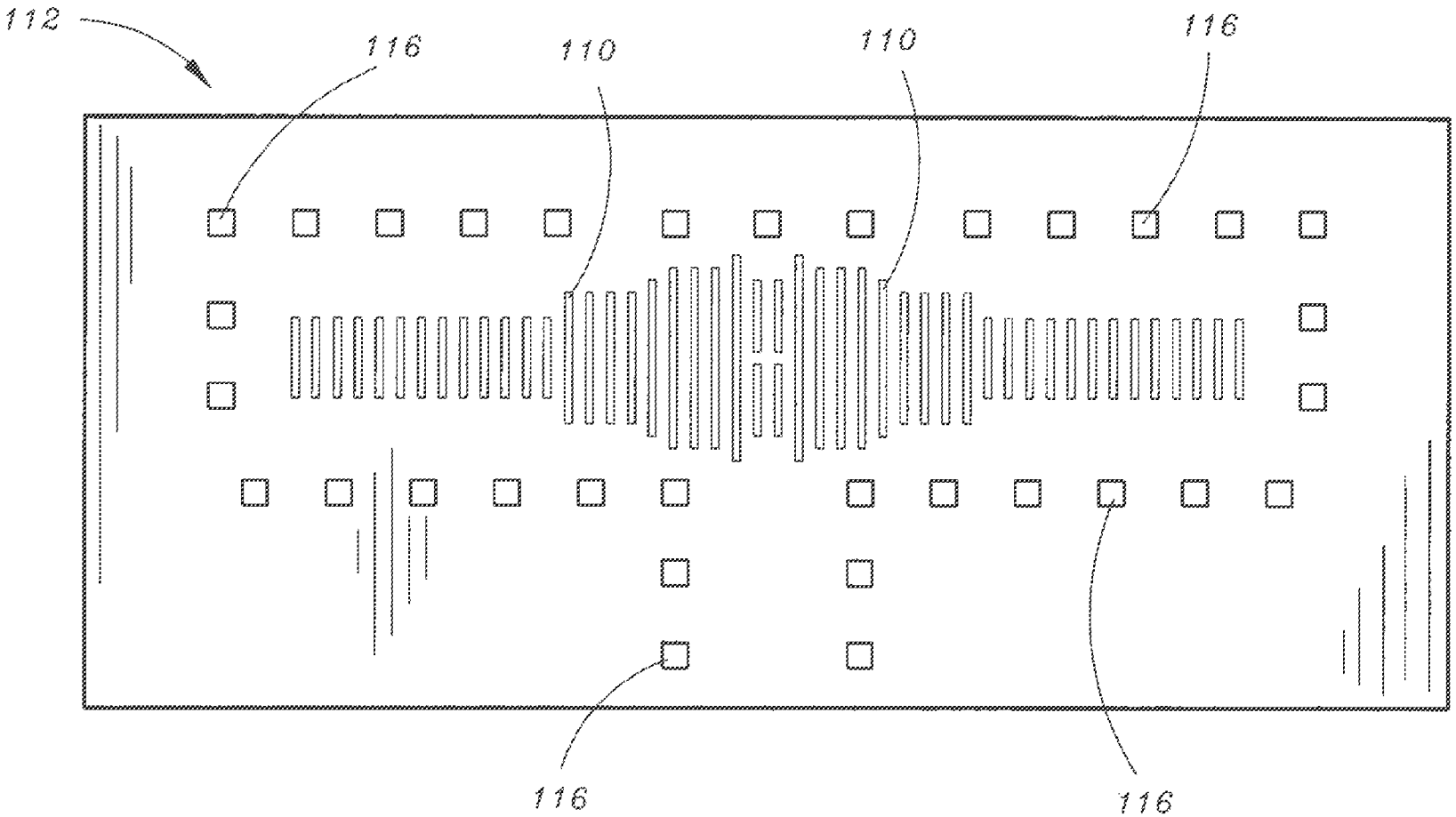
FIG. 3 is a top plan view of an upper metamaterial layer of an interface of the transition shown in FIG. 1, in accordance with an exemplary embodiment of the present invention.
Figure 4:
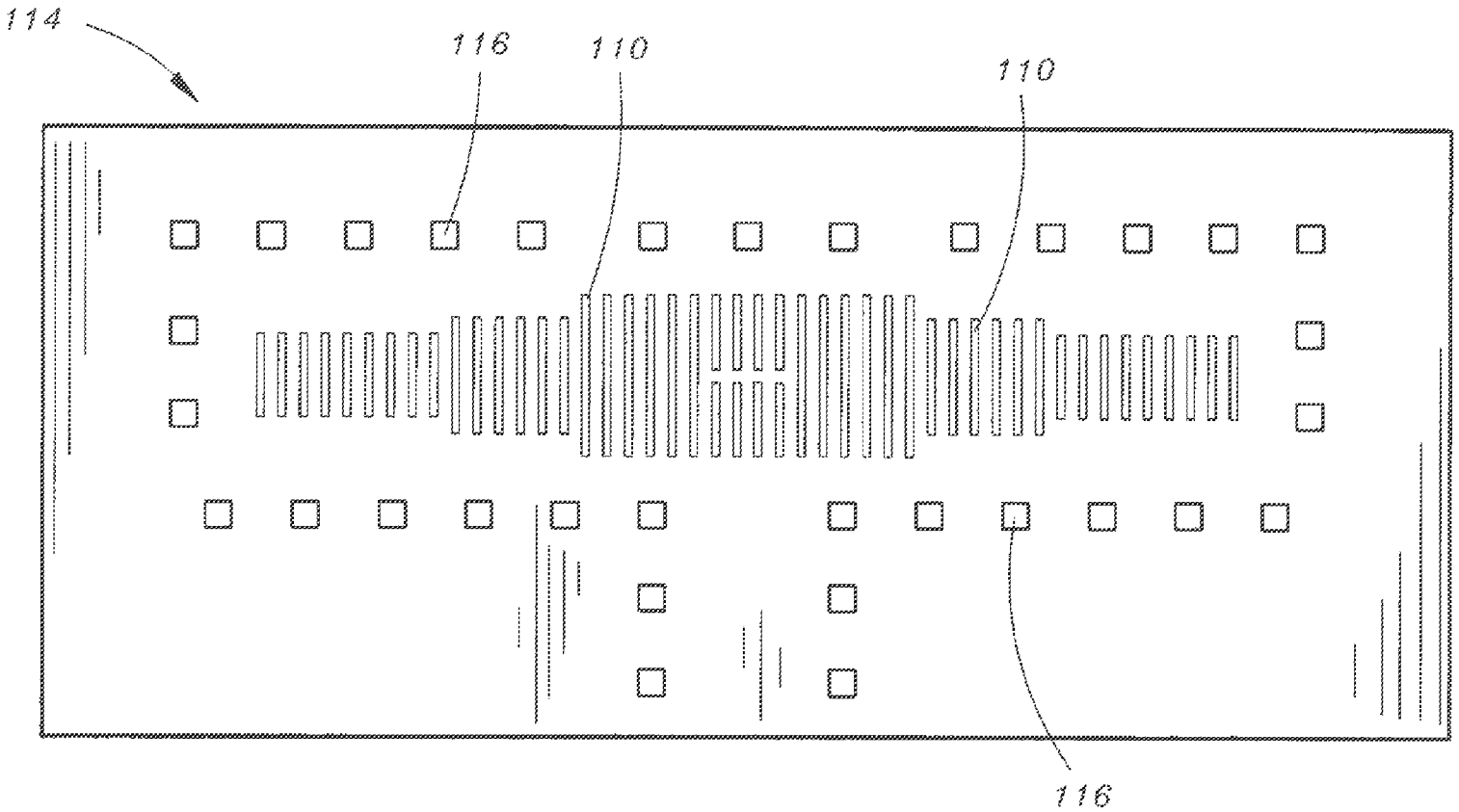
FIG. 4 is a top plan view of a lower metamaterial layer of the interface of the transition shown in FIG. 1, in accordance with an exemplary embodiment of the present invention.

In exemplary embodiments of the present invention, the metamaterial(s) 110 may be metal(s), such as copper as shown in FIGS. 3-4. For example, the copper may be etched on printed circuit board material via an etching process.

In alternative embodiments, the metamaterial(s) may be a paint of conductive material or may be embroiled wires. In further embodiments of the present invention, the metamaterials 110 may be configured for simulating an artificial electromagnetic boundary condition for defining a frequency of the structure formed by the volume occupied by the metamaterials 110. In current embodiments of the present invention, the metamaterials 110 may be selected for establishing a distinct frequency or set of frequencies over which the transition 100 may operate. In at least one embodiment of the present invention, the metamaterials 110 may be configured as generally rectangular-shaped structures as shown in FIGS.

3-4. In alternative embodiments, the metamaterials 110 may be configured in various shapes (e.g.—circularly-shaped, square-shaped, etc.), sizes, thicknesses, and/or established in various patterns within the metamaterial layers (112, 114). In further embodiments, the transition 100 may utilize the metamaterials 110 to provide a stripline mode-to-waveguide mode conversion (e.g.—to convert from TEM stripline mode to the waveguide's fundamental mode).

Referring to FIGS. 1, 3, 4, 5 and 6, in current embodiments of the present invention, the interface 106 (FIG. 1) and the stripline manifold 104 (FIG. 1) may be configured with a plurality of vias (e.g.—ground vias) 116 for providing isolation and for providing a ground structure for the transition 100 (FIG. 1). For instance, the plurality of ground vias (ex.—the through ground vias) 116 may be formed through (e.g.—may extend through) each of the plurality of layers of the interface 106 and through the stripline manifold 104 for providing the ground structure for the transition 100. In exemplary embodiments of the present invention, the vias 116 may be configured as generally square-shaped, longitudinally-extended channels. In alternative embodiments, the vias 116 may be configured in various shapes (e.g.—circularly-shaped channels, square-shaped channels, etc.), sizes and/or patterns.

In further embodiments of the present invention as shown in FIG. 5, at least one of the plurality of layers of the interface 106 may be a ground plane layer 118. In exemplary embodiments of the present invention, the ground plane layer 118 may be configured with a plurality of apertures (e.g.—ground plane slots) 120, which may be formed through the ground plane layer (e.g.—may extend from a top surface of the ground plane layer 118 through a bottom surface of the ground plane layer 118). In at least one embodiment of the present invention, the ground plane slots 120 may be generally rectangular-shaped slots. In alternative embodiments, the ground plane slots may be configured in various shapes (e.g.—circularly-shaped, square-shaped, etc.), sizes and/or patterns. In further embodiments of the present invention, the ground plane layer 118 may be located between the lower metamaterial layer 114 and the stripline manifold 104 (not shown).

In exemplary embodiments of the present invention, the plurality of layers of the interface 106, the stripline manifold 104, and the waveguide manifold 102 may be configured in various sizes, shapes, and/or thicknesses. In further embodiments, compared to currently available interfaces, the interface (e.g.—transition) 106 of the present invention may be relatively broadband and may be further configured for providing relatively low loss operation over a wider band of frequencies than previously available transitions. For example, the return loss for the interface 106 of the present invention may be well below −20 decibels (dB) over a frequency band ranging from 10.95 Gigahertz (GHz) to 14.50 Gigahertz (GHz).

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A transition, comprising:

a stripline manifold;

a waveguide manifold; and an interface, the interface configured to connect the stripline manifold and the waveguide manifold, the stripline manifold connected to a first side of the interface and the waveguide manifold is connected to a second side of the interface; the interface including:

a single ground plane layer located on top of said stripline manifold, the single ground plane layer being configured with a plurality of ground plane slots, the plurality of ground plane slots formed as apertures which extend from a top surface of the ground plane layer through a bottom surface of the ground plane layer and the apertures being spaced apart on the single ground plane layer, the single ground plane layer configured for being connected to the stripline manifold;

a first metamaterial layer located on said ground plane layer; and a second metamaterial layer, the second metamaterial layer located on said first metamaterial layer;

a plurality of ground vias, the plurality of ground vias being formed through the first metamaterial layer, the second metamaterial layer and the single ground plane layer for providing a ground structure for the interface.

2. The transition as claimed in claim 1, wherein the interface is configured for forming a resonant structure which provides a conversion between a first mode and a second mode for electromagnetic energy traversing through the interface between the stripline manifold and the waveguide manifold.

3. The transition as claimed in claim 1, wherein the first metamaterial layer includes copper.

4. The transition as claimed in claim 1, wherein the interface is formed of a printed circuit board material.

5. The transition as claimed in claim 1, wherein the interface is formed of liquid crystal polymer.

6. The transition as claimed in claim 2, wherein the first mode is a stripline TEM mode and the second mode is a waveguide fundamental mode.

7. The transition as claimed in claim 1, wherein the stripline manifold includes a stripline feed.

* * * * *